US006682171B2

(12) United States Patent
Otsuka

(10) Patent No.: US 6,682,171 B2
(45) Date of Patent: Jan. 27, 2004

(54) INK JET HEAD UNIT AND INK JET PRINTING APPARATUS INCORPORATING THE SAME

(75) Inventor: Nobutoshi Otsuka, Hotaka-machi (JP)

(73) Assignee: Seiko Epson Corporation, Tokyo (JP)

( * ) Notice: Subject to any disclaimer, the term of this patent is extended or adjusted under 35 U.S.C. 154(b) by 12 days.

(21) Appl. No.: 10/067,512

(22) Filed: Feb. 4, 2002

(65) Prior Publication Data

US 2002/0122093 A1 Sep. 5, 2002

(30) Foreign Application Priority Data

Feb. 13, 2001 (JP) ..... 2001-035108

(51) Int. Cl.[7] ..... B41J 2/21
(52) U.S. Cl. ..... 347/43; 347/40
(58) Field of Search ..... 347/43, 40, 12, 347/15

(56) References Cited

U.S. PATENT DOCUMENTS 5,428,375 A * 6/1995 Simon et al. ..... 347/12
5,602,574 A 2/1997 Williams
6,293,647 B2 * 9/2001 Saijo ..... 347/24

FOREIGN PATENT DOCUMENTS

| | | |
|---|---|---|
| DE | 197 43 804 | 4/1999 |
| EP | 0 391 570 | 10/1990 |
| EP | 0 666 174 | 8/1995 |
| JP | 10-095114 | 4/1998 |
| JP | 2001-038894 | 2/2001 |

* cited by examiner

*Primary Examiner*—Lamson Nguyen
(74) *Attorney, Agent, or Firm*—Hogan & Hartson, LLP

(57) ABSTRACT

There are provided an ink jet head unit which is capable of incorporating a large number of ink jet heads with ease and precision, and an ink jet printing apparatus incorporating the ink jet head unit. The ink jet head unit performs printing color printing by using a plurality of ink nozzle arrays each for use in printing one line, the plurality of ink nozzle arrays corresponding to a plurality of basic colors. A plurality of head groups are each formed by a plurality of ink jet heads, and have the plurality of ink nozzle arrays arranged therein such that the plurality of ink nozzle arrays are divided among the plurality of head groups. A plurality of sub-carriages have respective ones of the plurality of head groups mounted thereon. A unitizing carriage has the plurality of sub-carriages mounted thereon.

10 Claims, 15 Drawing Sheets

INK JET HEAD UNIT AND INK JET PRINTING APPARATUS INCORPORATING THE SAME

BACKGROUND OF THE INVENTION

1. Field of the Invention

This invention relates to an ink jet head unit for performing color printing by using a plurality of ink nozzle arrays each for use in printing one line, the plurality of ink nozzle arrays corresponding to a plurality of basic colors, and an ink jet printing apparatus incorporating the head unit.

2. Prior Art

Conventionally, an ink jet head unit of this kind was proposed e.g. by Japanese Laid-Open Patent Publication (Kokai) No. 10-95114. In this ink jet head unit, ink nozzle arrays each for use in printing one line are divided with respect to the direction along the line (by cutting each line in a direction crosswise to the direction along the line) into a plurality of divisional ink nozzle arrays, and ink jet heads are constituted by the divisional ink nozzle arrays, respectively. The plural ink jet heads formed as above are arranged in a manner staggered from each other on a support base, and each of them is fixed to the support base by two screws.

In the conventional ink jet head unit, since the ink nozzle arrays each for printing one line are divided to form the ink jet heads, the yield of the ink jet head unit can be improved. However, it is required to fix each of the plural ink jet heads onto the support base with precision, which makes it difficult to ensure positional accuracy between the ink jet heads.

SUMMARY OF THE INVENTION

It is an object of the invention to provide an ink jet head unit which is capable of incorporating a large number of ink jet heads with ease and precision, and an ink jet printing apparatus incorporating the ink jet head unit.

To attain the above object, according to a first aspect of the invention, there is provided an ink jet head unit for performing color printing by using a plurality of ink nozzle arrays each for use in printing one line, the plurality of ink nozzle arrays corresponding to a plurality of basic colors.

The ink jet head unit according to the first aspect of the invention is characterized by comprising:

- a plurality of head groups each formed by a plurality of ink jet heads, and having the plurality of ink nozzle arrays arranged therein such that the plurality of ink nozzle arrays are divided among the plurality of head groups;
- a plurality of sub-carriages having respective ones of the plurality of head groups mounted thereon; and
- a unitizing carriage having the plurality of sub-carriages mounted thereon.

According to this ink jet head unit, a plurality of ink jet heads constituting each head group are mounted on a sub-carriages, and hence it is possible to mount the ink jet heads on the sub-carriage with relatively high accuracy. Further, a plurality of sub-carriages thus constructed are mounted on a unitizing carriage. This makes it possible to mount all the ink jet heads on the unitizing carriage with relatively high accuracy. In short, by ensuring positional accuracy between each individual ink jet head and a corresponding one of the sub-carriages as well as between each sub-carriage and the unitizing carriage, it is possible to ensure a high mounting accuracy between each ink jet head and the unitizing carriage. Therefore, it is possible to mount a large number of ink jet heads on the unitizing carriage with precision, without any need to directly consider positional accuracy between the individual ink jet heads and the unitizing carriage.

It should be noted that the term "one line" mentioned above means "a line of dots corresponding to a sequence of ink nozzles on the head unit substantially corresponding to a printing width in a sub scanning direction". The term is intended to include a line of dots corresponding to a combination of divisional ink nozzle arrays, referred to hereinafter, and further, a line of dots in the case where the combination of divisional ink nozzle arrays are arranged in the sub scanning direction in an overlapping fashion. However, it is not intended to mean the width of a print medium.

Preferably, the plurality of ink nozzle arrays are each divided into a plurality of divisional ink nozzle arrays with respect to a direction along the one line, and are grouped into a plurality of divisional ink nozzle array groups each formed of corresponding ones of the plurality of divisional ink nozzle arrays, and the plurality of ink jet heads of each of the plurality of head groups have the plurality of divisional ink nozzle arrays of a corresponding one of the plurality of divisional ink nozzle array groups arranged therein such that the plurality of divisional ink nozzle arrays are divided among the plurality of ink jet heads.

According to this preferred embodiment, each divisional ink nozzle array group is formed by a plurality of ink jet heads and mounted on an associated sub-carriage. Therefore, it is possible to intensively arrange the (divisional) ink nozzle arrays of the basic colors. This makes printing, especially, color matching printing less susceptible to the accuracy or inaccuracy of the moving position of the head unit in the main scanning direction, so that it is possible to prevent degradation of print quality due to displacement of dots.

Alternatively, the head groups may be constructed such that each of them has ink nozzle arrays of a corresponding one of the basic colors.

Preferably, the plurality of sub-carriages are arranged in a manner staggered from each other on the unitizing carriage.

According to this preferred embodiment, the plurality of sub-carriages can be more intensively arranged on the unitizing carriage. Therefore, the unitizing carriage can be made compact in size, and a large number of ink jet heads can be intensively arranged.

More preferably, each of the ink jet heads comprises a head base plate, and a head body arranged in one substantial half of the head base plate toward one longitudinal side, the head body having a corresponding portion of the plurality of ink nozzle arrays arranged therein, and in each two of the plurality of head groups, adjacent to each other with respect to a direction along the line, the head body of each of the plurality of ink jet heads of one of the two head groups and the head body of each of the plurality of ink jet heads of another of the two head groups are arranged opposed to each other in a back-to-back fashion.

According to this preferred embodiment, the ink jet heads can be arranged further intensively.

Preferably, the plurality of ink jet heads are bonded to a corresponding one of the plurality of sub-carriages in a positioned state.

According to this preferred embodiment, each ink jet head is positioned on a corresponding one of the sub-carriages e.g. by using a jig and then fixedly bonded to the same. Therefore, differently from the case of fixing the ink jet heads by screws or the like, it is possible to effectively prevent positional displacement of the ink jet head. Moreover, this facilitates the work of fixing each ink jet head onto a sub-carriage.

Preferably, the unitizing carriage has a plurality of positioning pin groups provided on a surface thereof, for enabling each of the plurality of sub-carriages to be mounted in a positioned state, and each of the positioning pin groups positions a corresponding one of the plurality of sub-carriages on the unitizing carriage, with reference to a reference position set to a position of an outermost ink nozzle of an arbitrary one of the plurality of ink jet heads mounted on the corresponding one of the plurality of sub-carriages.

According to this preferred embodiment, in positioning each sub-carriage on the unitizing carriage, the position of the outermost ink nozzle of an ink jet head is set to a reference position for positioning the sub-carriage. Therefore, it is possible to minimize influence of positioning error between the sub-carriages and the unitizing carriage. Further, since the sub-carriages are each removable from the unitizing carriage, replacement of the sub-carriages is facilitated.

More preferably, the each of the positioning pin groups comprises a reference pin arranged in a manner corresponding to the reference position, an angle-limiting pin for positioning the corresponding one of the plurality of sub-carriages in a direction of rotation thereof about the reference pin on the unitizing carriage, an X-axis direction urging pin for urging the corresponding one of the plurality of sub-carriages in an X-axis direction toward the reference pin to thereby position the corresponding one of the plurality of sub-carriages in a Y-axis direction perpendicular to the X-axis direction, and a Y-axis direction urging pin for urging the corresponding one of the plurality of sub-carriages in the Y-axis direction toward the reference pin to thereby position the corresponding one of the plurality of sub-carriages in the X-axis direction.

According to this preferred embodiment, so long as excellent positional accuracy between the reference position, the reference pin and the angle-limiting pin is maintained, it is possible to fix (mount) the sub-carriage onto the unitizing carriage with ease and precision. Further, although the sub-carriages are made removable from the unitizing carriage, positioning accuracy cannot be spoiled.

To attain the above object, according to a second aspect of the invention, there is provided an ink jet printing apparatus incorporating the ink jet head unit according to the first aspect of the invention.

According to this ink jet printing apparatus, the positional accuracy between the plurality of ink jet heads and the unitizing carriage can be maintained, and hence it is possible to accurately arrange the ink nozzle array groups for printing lines of basic colors of ink. Further, since a faulty ink jet head can be replaced with a new one as required, it is possible to improve the yield of the ink jet head unit.

Preferably, the ink jet printing apparatus includes an X-Y moving mechanism for moving the ink jet head unit in a main scanning direction and a sub scanning direction, and the ink jet printing apparatus performs printing by causing the ink jet head unit to scan on a print medium in the main-scanning direction and the sub-scanning direction.

According to this preferred embodiment, print quality can be enhanced by constructing the X-Y moving mechanism with accuracy. Further, it is possible to minimize position-shifting operation of the ink jet head unit, thereby increasing the printing speed.

Preferably, the ink jet printing apparatus further includes a cleaning cap unit for sucking ink from the ink jet head unit, in a state held in intimate contact with the ink jet head unit, and the cleaning cap unit has a plurality of caps for intimate contact with the ink jet head unit, each of the plurality of caps having a size large enough to enclose at least one of the plurality of ink jet heads.

According to this preferred embodiment, by operating the X-Y moving mechanism, the ink jet head unit can be cleaned on an ink jet head(s)-on-ink jet head(s) basis. Therefore, it is possible to make the cleaning cap unit compact in size without causing any inconvenience of cleaning operation for the ink jet heads.

Preferably, the ink jet printing apparatus further includes a storage cap unit for being brought into intimate contact with the ink jet head unit to thereby seal ink nozzles of the plurality of ink nozzle arrays, and the storage cap unit is formed to have a size large enough to receive all of the ink jet heads of the ink jet head unit.

According to this preferred embodiment, it is possible not only to carry out excellent flushing of all the ink nozzles, but also to effectively prevent the ink nozzles from being dried up during storage. Further, since all the ink jet heads are collectively sealed by the single storage cap, manufacturing costs can be reduced, differently from a case in which a plurality of contact caps are provided for intimate contact with the respective heads. Further, since the storage cap and the cleaning cap are separately constructed, it is possible to reduce stain or dirt deposited on the ink head unit via the intimate contact caps.

The above and other objects, features, and advantages of the invention will become more apparent from the following detailed description taken in conjunction with the accompanying drawings.

DETAILED DESCRIPTION OF PREFERRED EMBODIMENT

The invention will now be described in detail with reference to drawings showing an ink jet printing apparatus incorporating an ink jet head unit according to an embodiment of the invention. The printing apparatus is a large-sized color printer for business use, which is capable of continuously printing label images by the ink jet printing method. More specifically, the printing apparatus is capable of continuously printing a large number of unit images on a printing tape as a continuous paper, which has a release paper laminated thereon, such that portions of the tape printed with the unit images can be cut out afterwards for use as labels, and makes it possible to carry out small-lot printing e.g. for producing labels to be affixed to wrapping films for wrapping perishable food.

Figure 1:
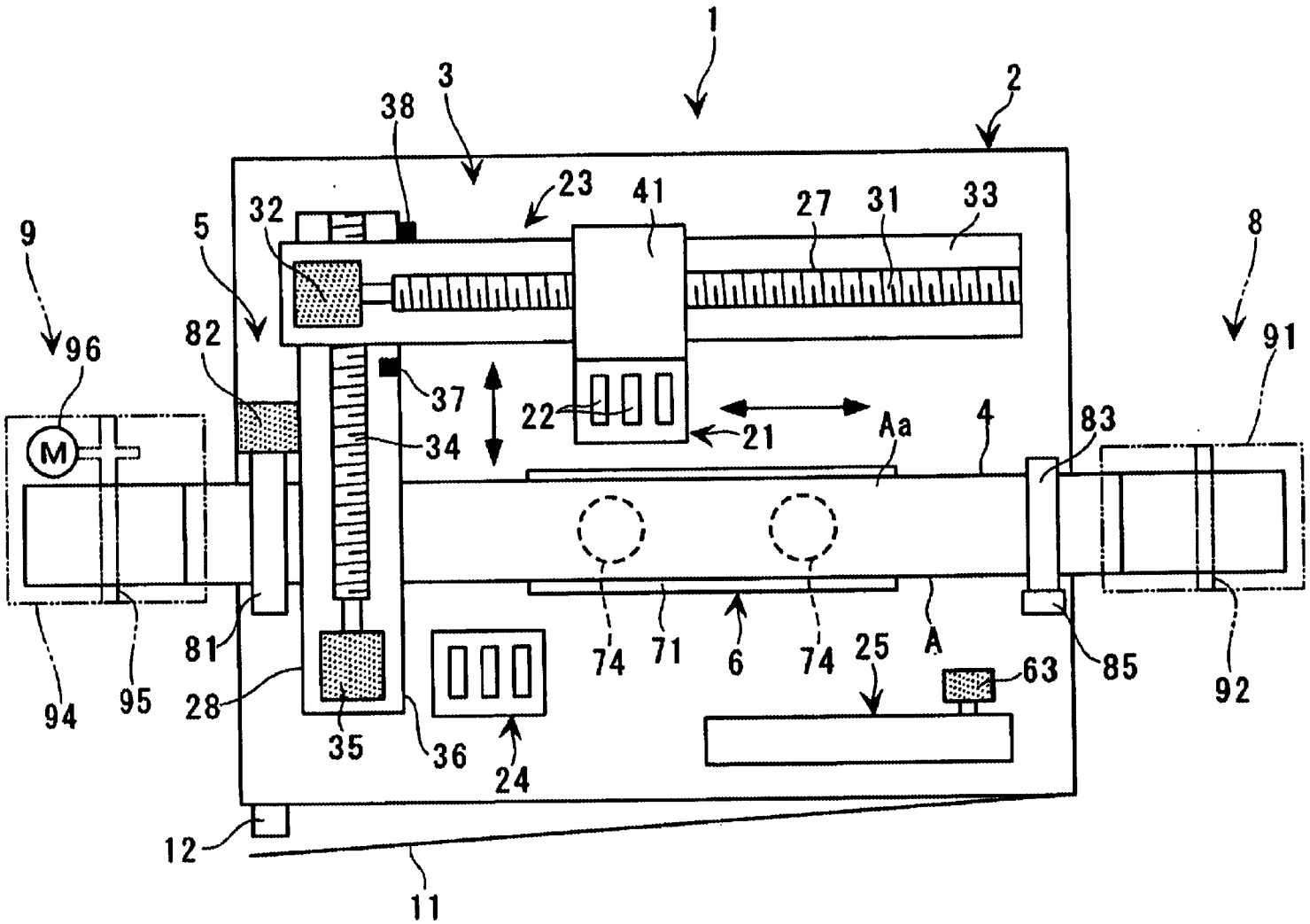
FIG. 1 is a plan view of a printing apparatus according to an embodiment of the invention.
Figure 2:
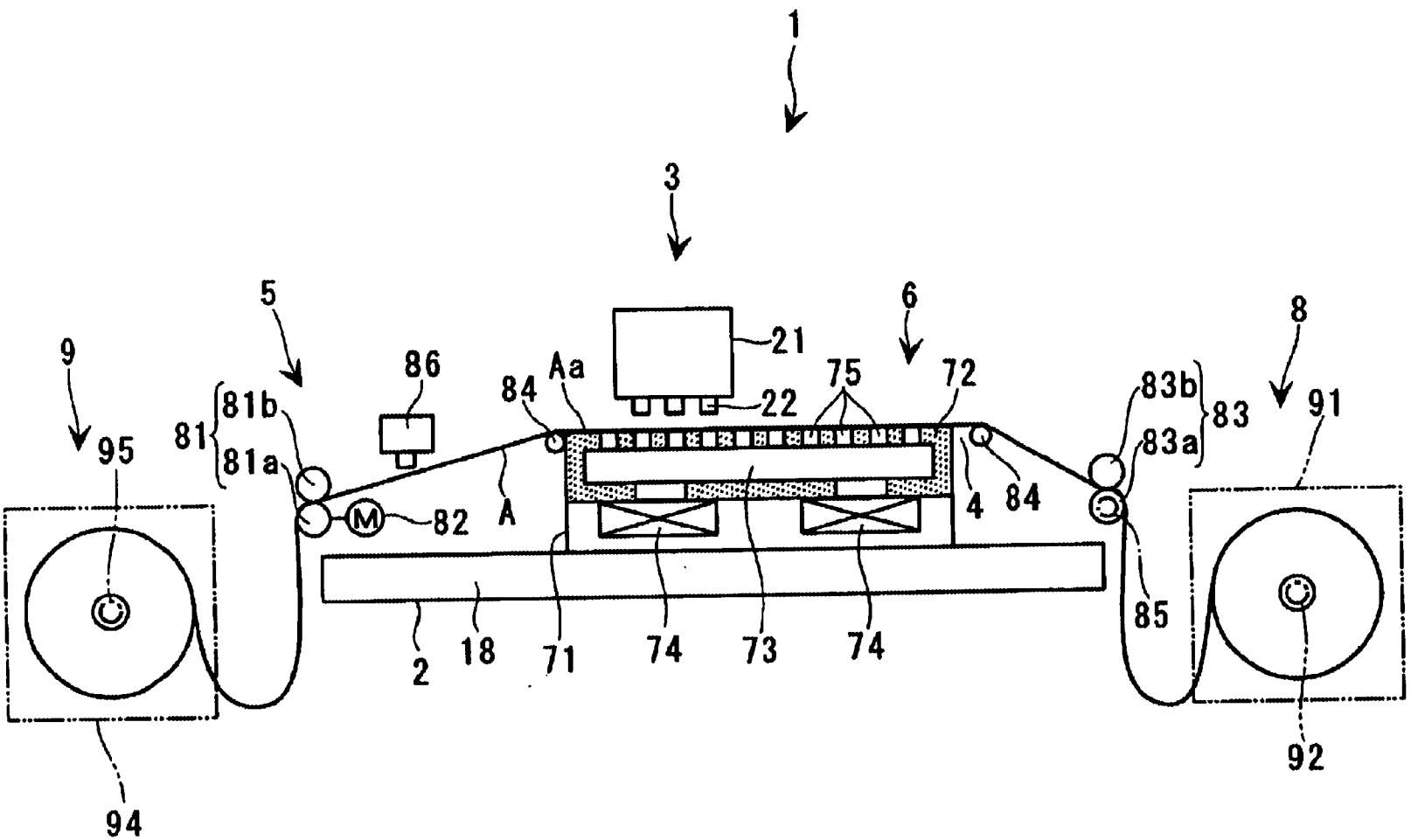
FIG. 2 is a cross-sectional view of the FIG. 1 printing apparatus.
Figure 3:
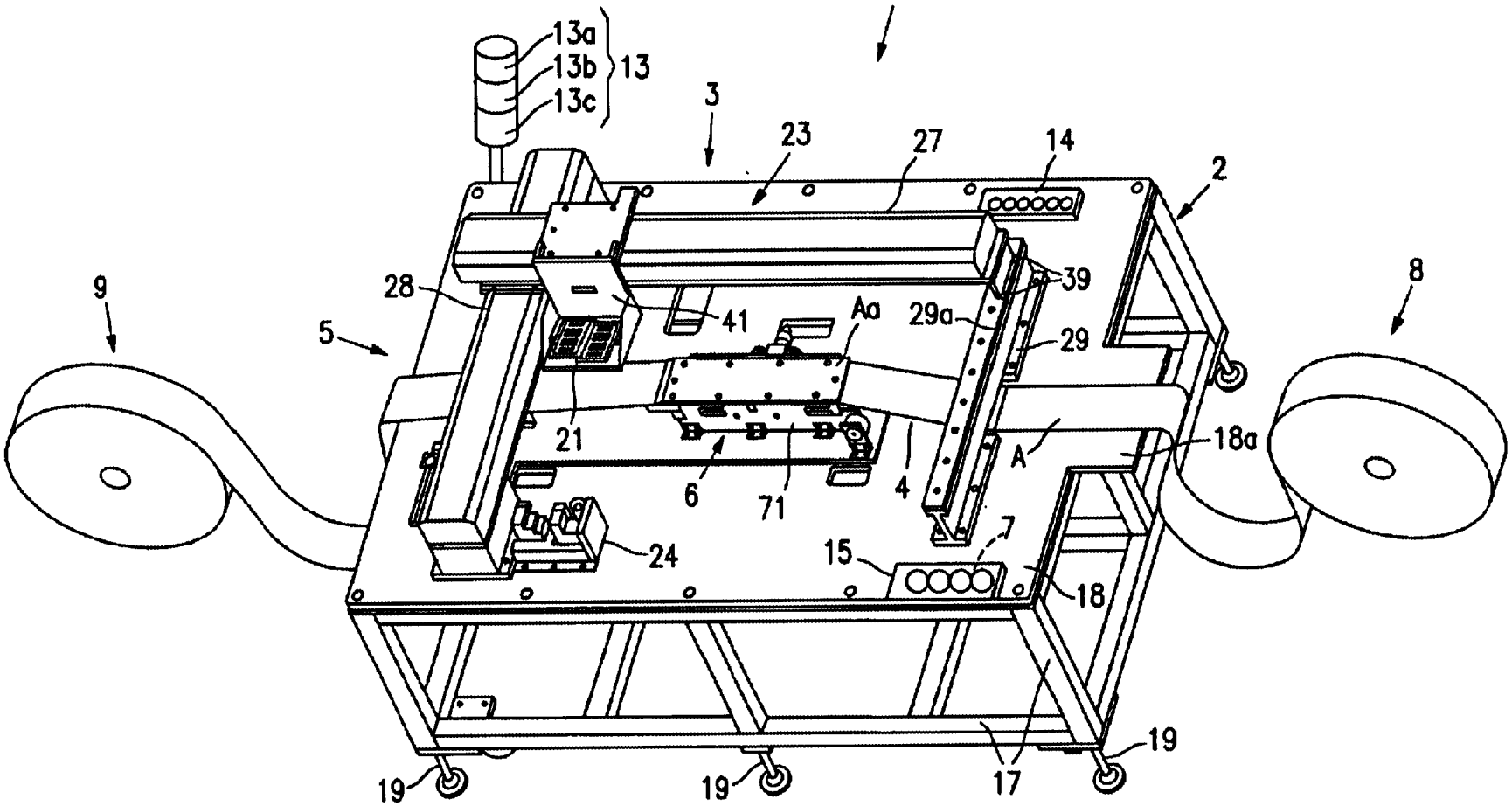
FIG. 3 is a perspective view showing the appearance of the FIG. 1 printing apparatus.

FIG. 1 schematically shows the printing apparatus in plan view, while FIG. 2 shows the same in cross section. Further, FIG. 3 shows the appearance of the whole printing apparatus. As shown in the figures, the printing apparatus 1 includes a base 2, a printing mechanism 3 arranged above the base 2, a tape feeding mechanism 5 for feeding a printing tape A along a tape feeding path 4 extending longitudinally on the base 2, a suction table 6 arranged in a central portion of the tape feeding path 4, and a controller (control means) 7 for controlling the mechanisms 3 and 5. The printing apparatus 1 further includes a tape supply device 8 for rolling out a roll of the printing tape A and delivering the same to the tape feeding mechanism 5, and a tape take-up device 9 for taking up printed part of the printing tape A received from the tape feeding mechanism 5 into a roll.

The printing tape A as a print medium is in the form of a roll of continuous paper with a so-called release paper laminated thereon. The printing tape A includes a plurality of kinds having respective tape widths ranging from 50 mm to 150 mm. In printing, images (unit images) B for labels are continuously printed on the printing tape A along the length of the same (see FIG. 4D). The respective portions of the printing tape A each printed with the unit image B are half-cut by a cutter device provided separately from the printing apparatus 1, whereby labels with adhesive are produced.

Inks for the printing, or color printing of lines, are those of six basic colors, i.e. cyan (C), magenta (M), yellow (Y), black (K), light cyan (LC) and light magenta (LM). The inks of these six colors are supplied from ink tanks (stationary ink tanks) to respective ink jet heads 22 of an ink head unit 21 via associated ink tubes, as described in detail hereinafter.

On the base 2, there is provided a safety cover, not shown, covering the above-mentioned mechanisms and devices as a unit. The safety cover has a door 11 provided on a front face thereof (see FIG. 1). Further, a detection switch (detection sensor) 12 is attached to the safety cover, for detecting closing of the door 11. The main power is turned on only in a state of the closing of the door 11 having been detected by the detection switch 11. Further, when the door 11 is opened in an ON state of the main power, the main power is turned off via the detection switch 11.

In FIG. 3, reference numeral 13 designates an alarm lamp (which is actually erected on the safety cover). The alarm lamp 13 includes an ink indicator lamp 13*a* for indicating ink end, a tape indicator lamp 13*b* for indicating tape end, and an operation indicator lamp 13*c* for indicating that the apparatus is in printing operation (in operation). Reference numeral 14 in the figure designates a group of ink lamps for each indicating the presence or absence of a corresponding one of the inks of the six colors, described in detail hereinafter. Further, reference numeral 15 in the figure designates an operation panel. On the surface of the operation panel, there are arranged a power switch (main power), an emergency stop switch, a pause switch, a re-start switch, a tape feed switch (for idle or non-printing feeding), a head cleaning switch, and so forth. The operation panel 15 has a circuit board built therein which forms the aforementioned controller 7.

The base 2 is formed by assembling angle bars 17 into a base support having a rectangular parallelepiped shape and fixing a base plate 18 on the base support. The base 2 has six legs 19 attached to a bottom thereof such that each of the legs 19 can be adjusted in height. Further, the base 2 has an overhang 18*a* extending outward from one end thereof in a longitudinal direction, on which operation for extending the tape A by joining another thereto is carried out (see FIG. 3).

On the base plate 18, there are arranged main ink tanks (stationary tanks), not shown, for containing the inks of the respective colors, in a state secured on a small base, not shown. The inks can be delivered from the main ink tanks to subsidiary ink tanks (stationary tanks) also arranged on the base plate 18. The respective inks of the colors are further delivered from the subsidiary ink tanks to the ink jet heads 22, described in detail hereinafter, via the respective associated ink tubes. The indicating operations of the ink indicator lamp 13*a* and the ink lamp group 14 are performed based on results of detection concerning the presence or absence of the respective inks in the main ink tanks.

The printing mechanism 3 includes a head unit (ink jet head unit) 21 including a large number of ink jet heads 22, an X-Y moving mechanism 23 for moving the head unit 21, as required, in main and sub scanning directions, a storage unit 24 for use in storing the ink jet heads 22 (when they are not in operation) and in flushing the same, and a cleaning unit 25 for use in (manually) cleaning the ink jet heads 22.

The X-Y moving mechanism 23 is a so-called X-Y robot installed on the base 2. The X-Y moving mechanism 23 is comprised of an X-axis stage 27 for moving the head unit 21 in an X-axis direction (main scanning direction), a Y-axis stage 28 for moving the X-axis stage 27 in a Y-axis direction (sub scanning direction), and a Y-axis guide rail 29 for guiding the motion of the X-axis stage 27. The X-axis stage 27 is comprised of a main scanning ball screw 31 for reciprocating the head unit 21 in the main scanning direction (X-axis direction), a main scanning motor 32 for rotating the main scanning ball screw 31 in normal and reverse directions, and an X-axis casing 33 housing these components.

The Y-axis stage 28 is comprised of a sub scanning ball screw 34 for reciprocating the head unit 21 in the sub scanning direction (Y-axis direction), a sub scanning motor 35 for rotating the sub scanning ball screw 34 in normal and reverse directions, and a Y-axis casing 36 housing these components. The Y-axis guide rail 29 extends in parallel with the Y-axis stage 28, and cooperates with the Y-axis stage 28 to support the X-axis stage 27 at opposite ends thereof and guide the reciprocating motion of the same.

In FIG. 1, reference numeral 37 designates an X-axis direction sensor for detecting a reference position (home position) of the head unit 21 in the X-axis direction, while reference numeral 38 designates a Y-axis direction sensor for detecting a reference position (home position) of the head unit 21 in the Y-axis direction. Whenever the main power of the printing apparatus 1 is turned on, the X-Y moving mechanism 23 is reset to the reference position in the X-axis and Y-axis directions.

The head unit 21 has a female screw block, not shown, attached thereto such that the female screw block extends into the X-axis casing 33 through a horizontal slit formed in the X-axis casing 33, and the female screw block is engaged with the main scanning ball screw 31. Similarly, attached to one end of the X-axis stage 27 is a female screw block, not shown, such that the female screw block extends into the Y-axis casing 36 through a horizontal slit formed in the Y-axis casing 36, and the female screw block is engaged with the sub scanning ball screw 34. Further, the X-axis stage 27 has a pair of guide rollers 39, 39 attached to the other end thereof such that the guide rollers 39, 39 can roll along a rail portion 29*a* of the Y-axis guide rail 29 (see FIG. 3).

The main scanning motor 32 and the sub scanning motor 35 are connected to the controller 7. When the controller 7 causes normal and reverse rotations of the main scanning motor 32, the head unit 21 performs reciprocating motion in the main scanning direction, whereas when the controller 7 causes normal and reverse rotations of the sub scanning motor 35, the head unit 21 performs reciprocating motion in the sub scanning direction. Printing of each line is effected by the motion of the head unit 21 in the main scanning direction, and a shift of the head unit 21 so as to print each next line is effected by the motion of the head unit 21 in the sub scanning direction.

More specifically, referring to FIGS. 1 and 4A to 4C, when printing is started e.g. with an upper left-hand position on the tape as a printing-start position P1, the head unit 21 is moved rightward (in the main scanning direction) from the printing-start position P1, whereby printing (main scanning) of first lines (first in the sub scanning direction) is carried out, and then after being moved forward (downward as viewed in the figures) from an upper right-hand end for shift (sub scanning) to second lines (second in the sub scanning direction), the head unit 21 is moved leftward (in the main scanning direction), whereby printing (main scanning) of the second lines is carried out. Similar operations are repeatedly carried out for printing of all lines (see FIG. 4B). Further, e.g. when printing is completed at a lower right-hand position, the following printing after a tape feed is carried out from the printing-end position P2 toward the printing-start position P1 for printing of all the lines, following the above operating procedure in reverse (see FIG. 4C). Thus, time losses due to movement of the head unit 21 can be reduced.

Figure 5:
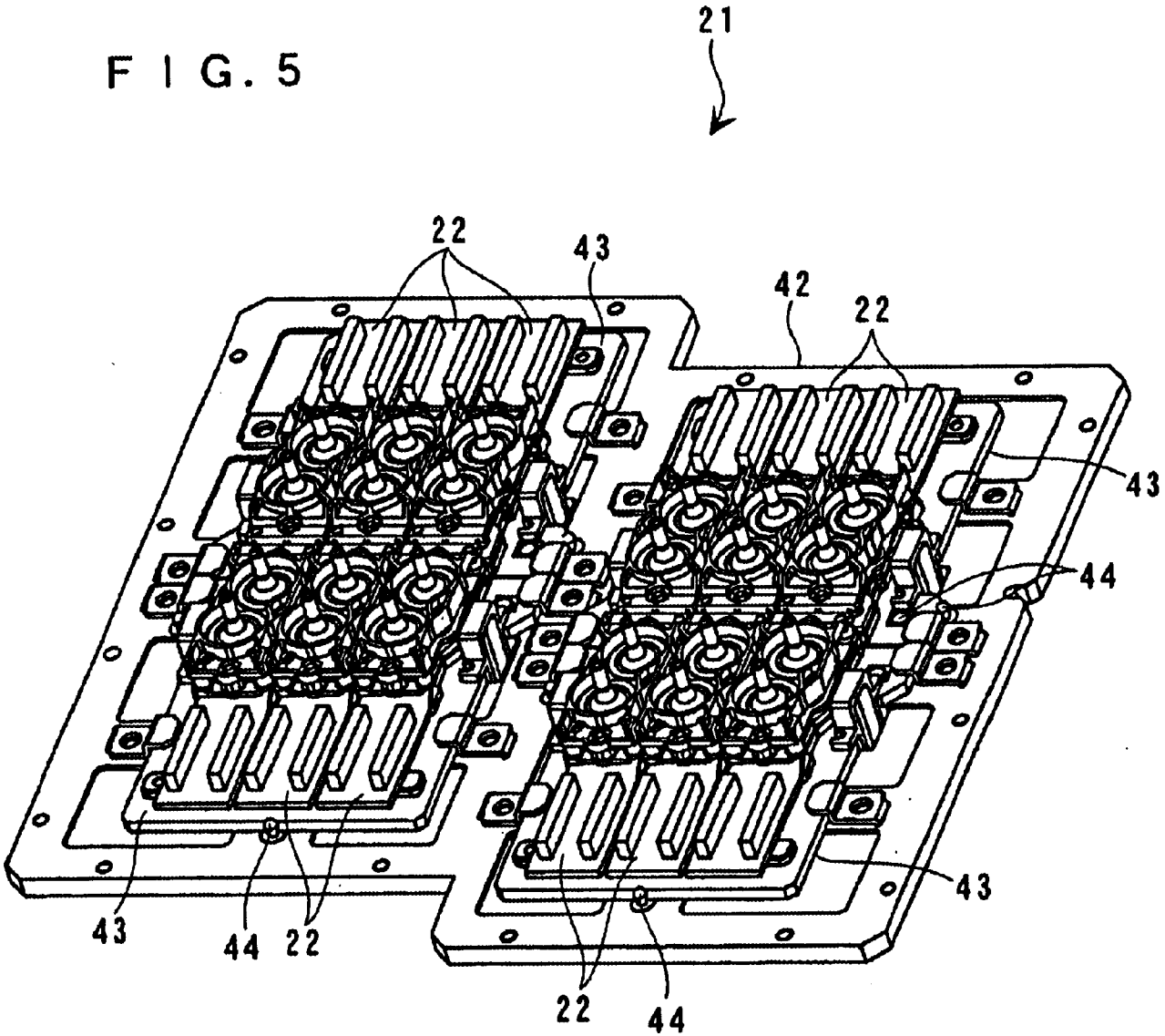
FIG. 5 is a perspective view showing the appearance of the head unit.

As shown in FIGS. 3 and 5, the head unit 21 includes a support bracket 41 having the female screw block attached to a rear surface thereof, a unitizing carriage 42 horizontally attached to a lower portion of the support bracket 41, and four sub-carriages 43 removably mounted on the unitizing carriage 42. Each of the sub-carriages 43 has three ink jet heads 22 mounted thereon in a row. In other words, twelve ink jet heads 22 in total are mounted on the four sub-carriages 43.

The ink jet heads 22 are each fixedly bonded to a corresponding one of the four sub-carriages 43, and the four sub-carriages 43 are removably mounted on the unitizing carriage 42 by positioning/mounting means 44 comprised of a plurality of pins. Further, the ink jet heads 22 mounted on each of the sub-carriages 43 have main bodies 22*a*, respectively, each formed with ink nozzles and projecting downward from the unitizing carriage 42. The ink jet heads 22 on one sub-carriage 43 are arranged in a manner such that the main bodies 22*a* thereof are opposed to those of the ink jet heads 22 on another sub-carriage 43 adjacent to the one sub-carriage 43 in the Y-axis direction, whereby the ink nozzles are intensively disposed to form an ink nozzle array group 46 (see FIG. 6).

Figure 6:
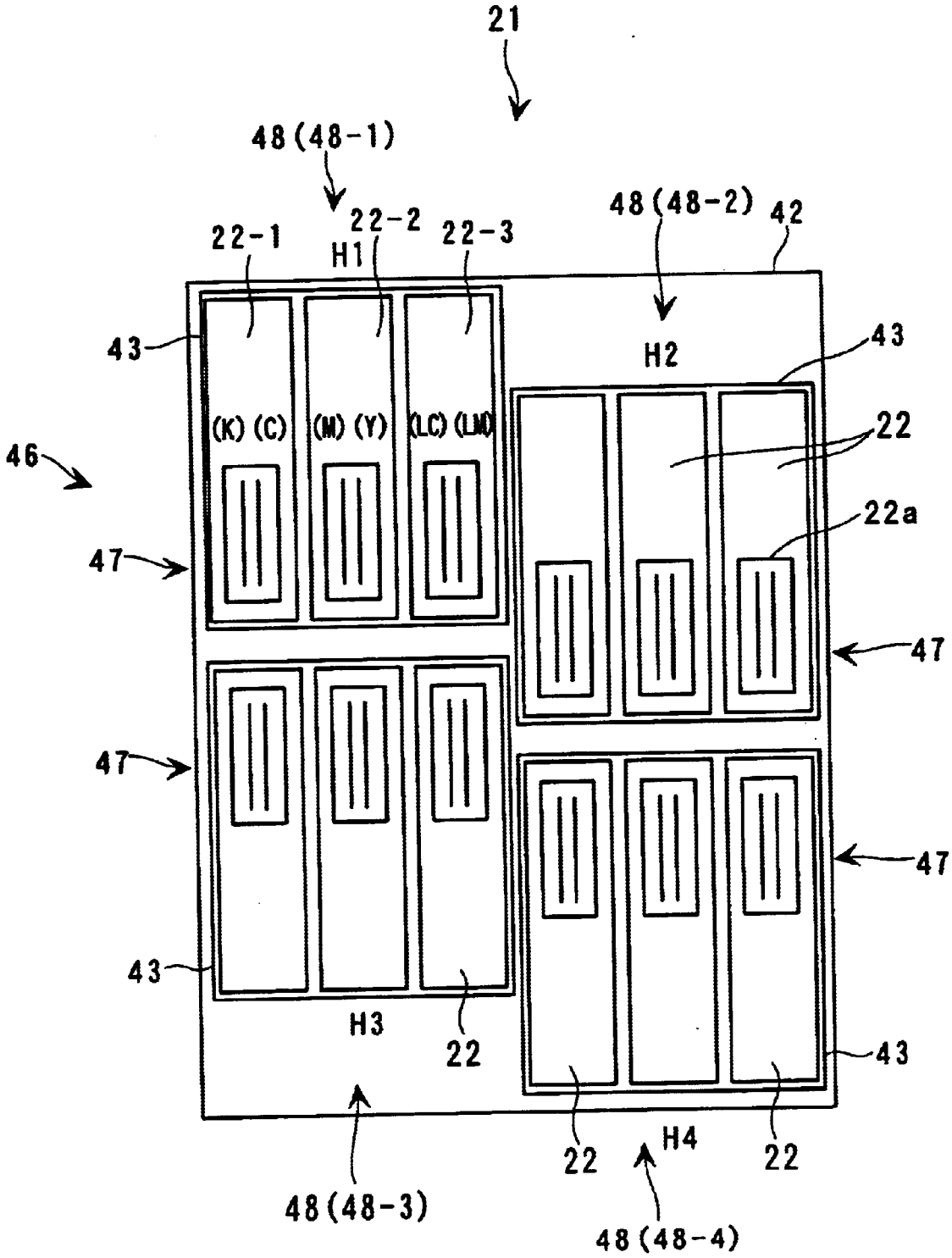
FIG. 6 is a view schematically showing the construction of the head unit.

As schematically shown in FIG. 6, the ink nozzle array group 46 of ink nozzle arrays of the six colors employed as basic colors is divided into four divisional ink nozzle array groups, and the divisional ink nozzle array groups 47 each including ink nozzle arrays of the six colors are mounted on the sub-carriages 43, respectively, in a state incorporated in the three ink jet heads 22. More specifically, a first head 22-1 of the three ink jet heads 22 mounted on each of the sub-carriages 43 incorporates two divisional ink nozzle arrays 47*a* of black (K) and cyan (C) colors, a second head 22-2 incorporates two divisional ink nozzle arrays 47*a* of magenta (M) and yellow (Y) colors, and a third head 22-3 incorporates two divisional ink nozzle arrays 47*a* of light cyan (LC) and light magenta (LM) colors. The divisional nozzle array groups 47 are arranged in a manner staggered from each other with portions thereof partially overlapping each other. The head unit 21 will be described in more detail hereinafter.

Figure 7:
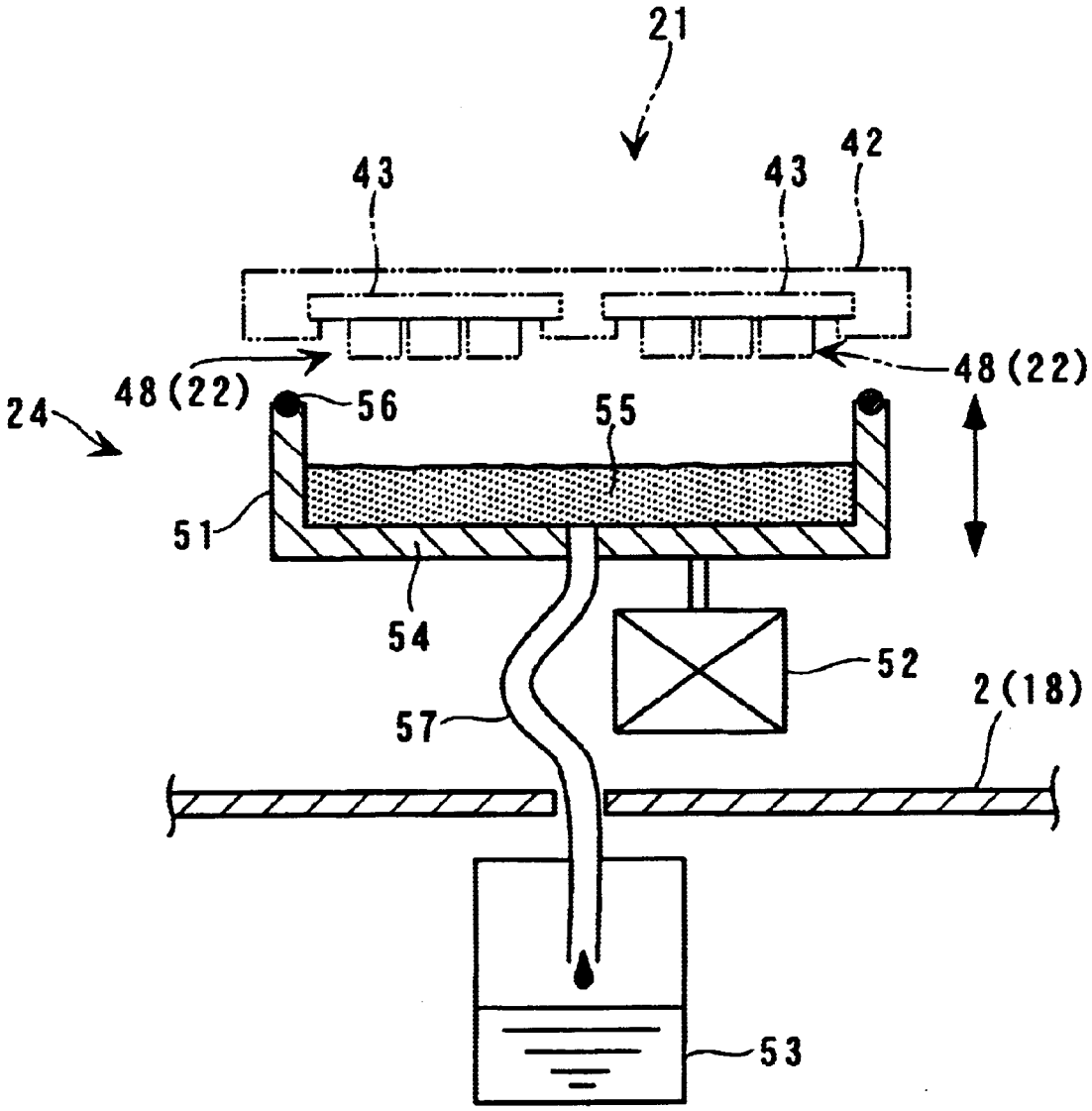
FIG. 7 is a cross-sectional view schematically showing the construction of a storage unit.
Figure 8:
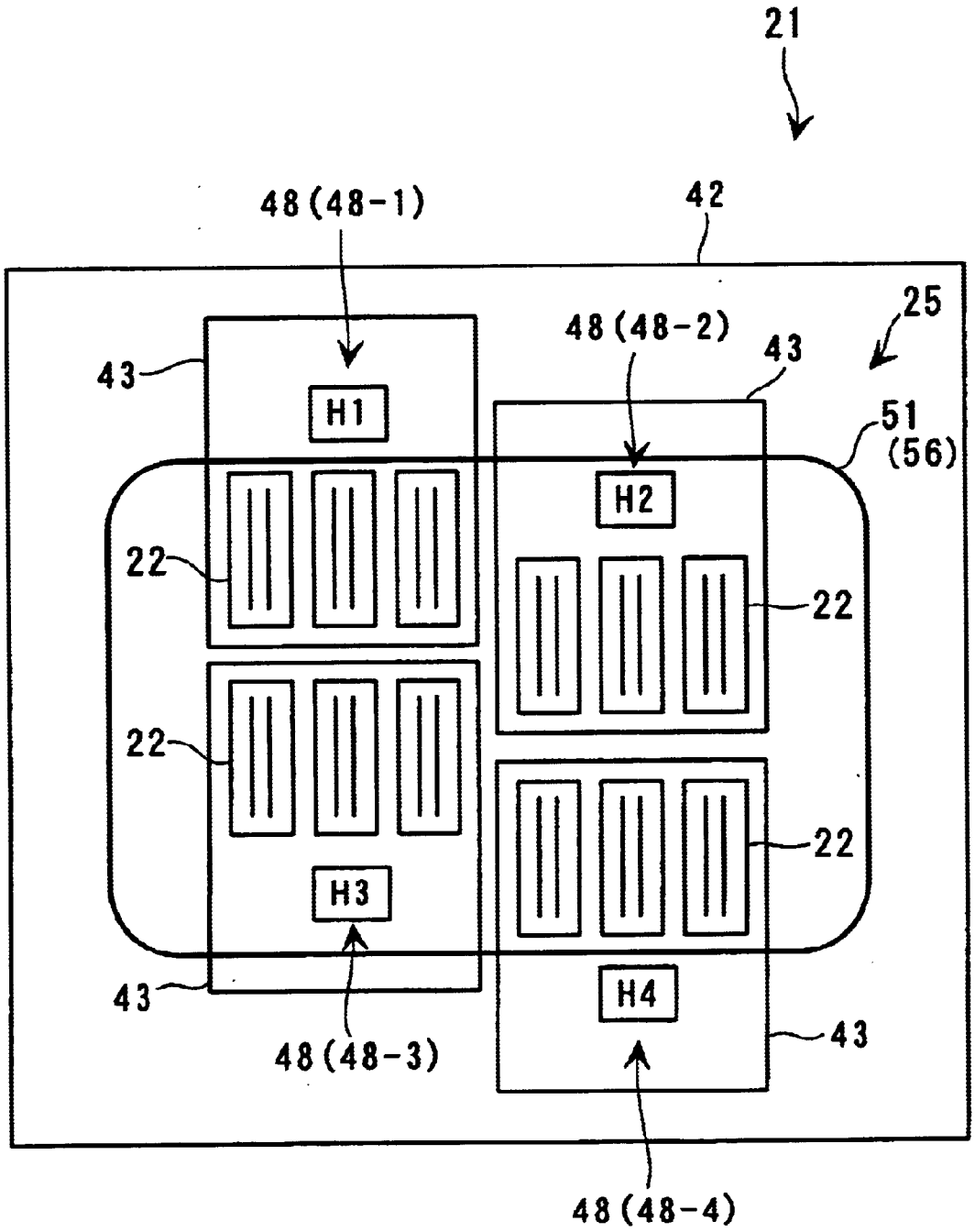
FIG. 8 is a plan view schematically showing the storage unit and the head unit.

The storage unit 24 is arranged on the base 2 at a location close to a portion of the Y-axis stage 28 frontwardly, or downwardly as viewed in FIG. 1, off the tape feeding path 4. As shown in FIGS. 7 and 8, the storage unit 24 is comprised of a storage cap 51, a lift device 52 for moving the storage cap 51 up to and away from the head unit 21, and a waste ink tank 53 for storing ink dropping from the storage cap 51. Needless to say, the lift device 52 is connected to the controller 7.

The storage cap 51 is comprised of a cap body 54, an ink absorbent material 55 filling a lower portion within the cap body 54, and a seal member 56 formed by a generally square O ring mounted to the upper periphery of the cap body 54. The seal member 56 is large enough to enclose all the ink jet heads 22, and hence it can be brought into intimate contact with the underside surface of the unitizing carriage 42, for sealing all the ink jet heads 22.

When the head unit 21 is brought to a position immediately above the storage cap 51 for flushing, the lift device 52 holds the storage cap 51 in its lowered position, whereas when the head unit 21 is brought to the position immediately above the storage cap 51 for storage, the lift device 52 lifts the storage cap 51 to bring the same into intimate contact with the head unit 21. Ink discharged by flushing is absorbed in the ink absorbent material 55, and when the ink absorbent material 55 becomes saturated with the ink, the ink drops through a tube 57 into the waste ink tank 53 arranged below the base plate 18. On the other hand, when the storage cap 51 is held in intimate contact with the head unit 21 for storage, the inside of the storage cap 51 is held in a very humid state by the ink absorbed in the ink absorbent material 55, which effectively prevents the ink jet heads (ink nozzles) 22 from being dried.

Figure 9:
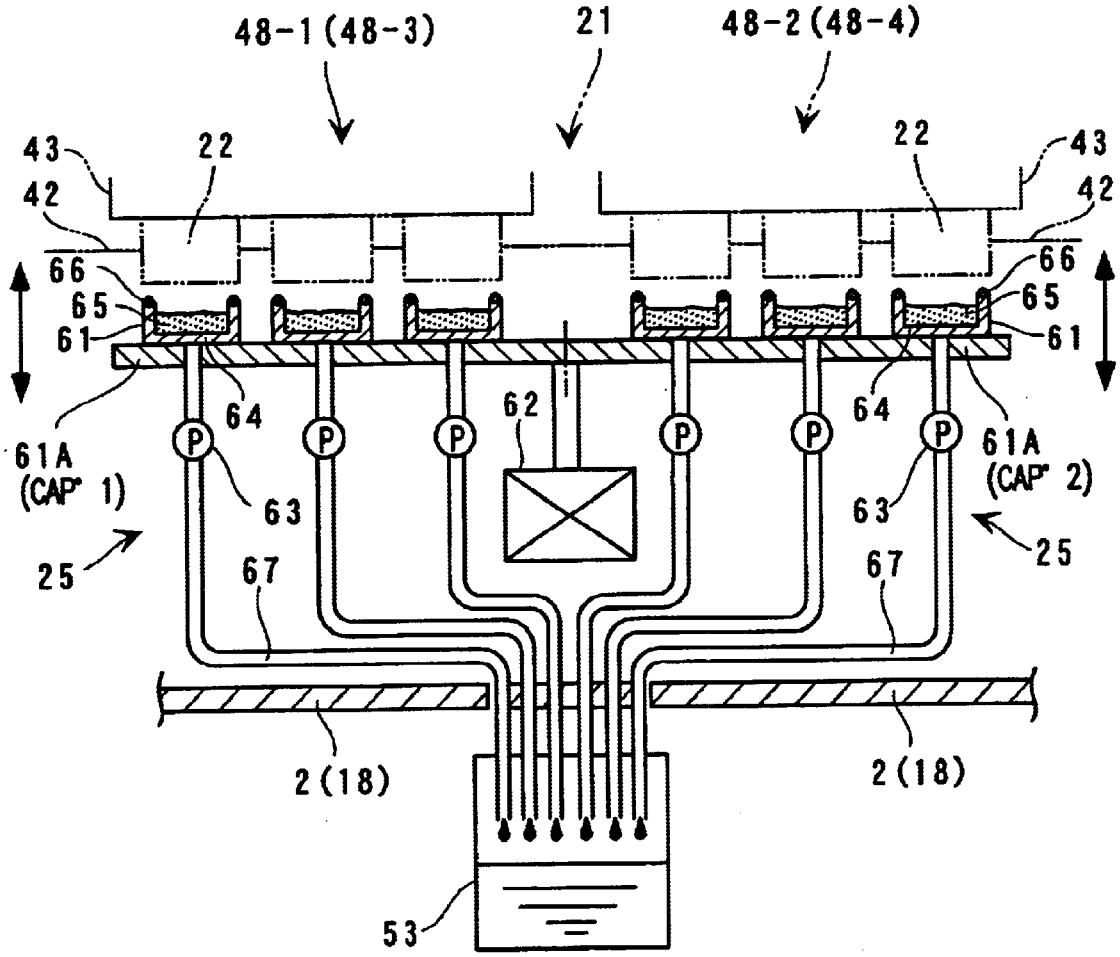
FIG. 9 is a cross-sectional view schematically showing the construction of a cleaning unit.
Figure 10:
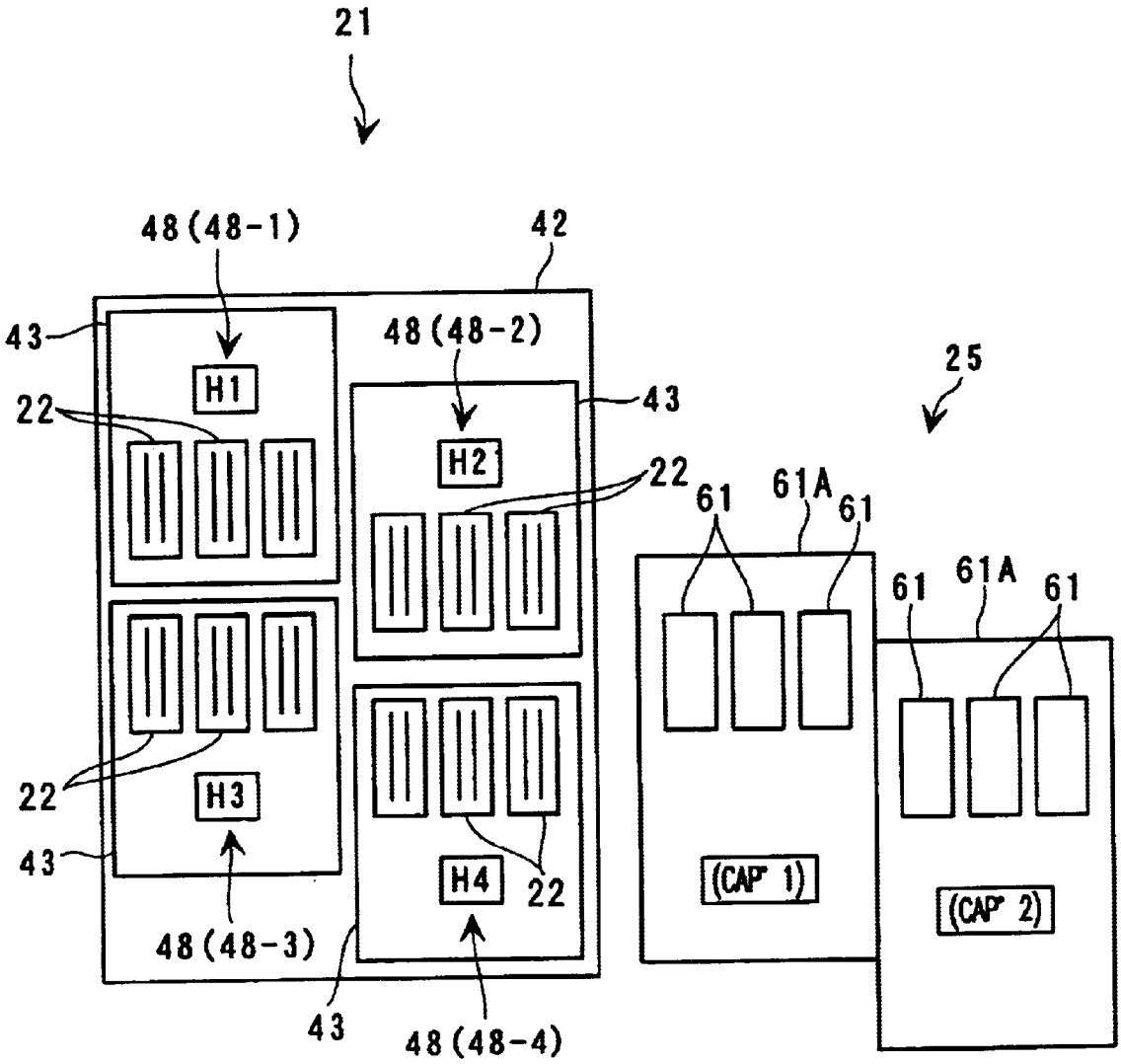
FIG. 10 is a plan view schematically showing the cleaning unit and the head unit.

The cleaning unit 25 is arranged on the base 2 at a location frontwardly off the tape feeding path 4. As shown in FIGS. 9 and 10, the cleaning unit 25 is comprised of a pair of cap bases 61A, 61A each having three cleaning caps 61 mounted thereon, a lift device 62 for lifting and lowering the pair of cap bases 61A, 61A to thereby move the six cleaning caps 61 up to and away from the head unit 21, and six ink pumps 63 for sucking ink via the respective cleaning caps 61. The lift device 62 and the ink pumps 63 are each connected to the controller 7.

Each of the cleaning caps 61 is comprised of a cap body 64, an ink absorbent material 65 filling the lower portion within the cap body 64, and a seal member 66 mounted on the upper end or brim of the cap body 64. The pair of cap bases 61A, 61A are coupled to each other, and each of the cap bases 61A, 61A has the three cleaning caps 61 mounted thereon in a row in a manner corresponding to the three ink jet heads (head group 48) 22 mounted on the sub-carriage 43.

More specifically, one (CAP 1 in the figures) of the cap bases 61A, 61A corresponds to a first head group 48-1 (and a third head group 48-3), while the other cap base (CAP 2 in the figures) 61A corresponds to a second head group 48-2 (and a fourth head group 48-4). Further, the pair of cap bases 61A, 61A are arranged in a manner displaced from each other in the Y-axis direction such that they can correspond to two adjacent head groups (the first and second head groups; and the third and fourth head groups) 48. The lift device 62 lifts and lowers the pair of cap bases 61A, 61A in unison.

When the first head group 48-1 and the second head group 48-2 are brought to a position above the pair of cap bases 61A, 61A for cleaning, the lift device 62 operates to lift the cap bases 61A, 61A for intimate contact between all the cleaning caps 61 and the head unit 21. Subsequently, the ink pumps 63 operate to suck ink (for cleaning) from the respective ink jet heads 22 of the first head group 48-1 and the second head group 48-2.

Then, the lift device 62 operates again to lower all the cleaning caps 61, and at the same time, the X-Y moving mechanism 23 operates to move the third head group 48-3 and the fourth head group 48-4 in the Y-axis direction and bring the head groups to the pair of cap bases 61A, 61A. Subsequently, lifting of the cleaning caps 61 and pumping operation are carried out for suction of ink (for cleaning) from the respective ink jet heads 22 of the third head group 48-3 and the fourth head group 48-4.

The inks sucked by the respective ink pumps 63 are each guided to the waste ink tank 53 through a corresponding one of the ink tubes 67. Since the head unit 21 can be moved, as required, by the X-Y moving mechanism 23 as described above, it is possible to reduce the number of caps, thereby making the cleaning unit 25 compact in size. It should be noted that if it is required to further reduce the number of caps, one (CAP 2 in the figures) of the cap bases 61A can be omitted. In this case, four pumping operations are needed to complete the cleaning. Further, it is possible even to form a cleaning unit 25 having a single cap, though a further increased number of pumping operations are needed.

As shown in FIGS. 2 and 3, the suction table 6 is comprised of a casing 71 fixedly arranged on the base 2, a suction plate 72 mounted on the upper surface of the casing 71, a suction chamber 73 formed under the suction plate 72, and a pair of suction fans 74, 74 arranged in a manner continuous with the suction chamber 73. The suction plate 72 longitudinally extending along the tape feeding path 4 has an upper surface thereof formed with a large number of suction holes 75 each communicating with the suction chamber 73. Further, the suction plate 72 is arranged in a horizontal position such that it can be opposed to the ink jet heads 22 moving immediately thereover in the X-axis and Y-axis directions in parallel therewith. More specifically, the printing tape A sucked onto the upper surface of the suction plate 72 can be opposed to the ink jet heads 22 in parallel therewith with a predetermined space maintained therefrom for receiving ink droplets ejected from the ink jet heads 22.

The pair of suction fans 74, 74 are connected to the controller 7 and operated in synchronism with turning-on of the main power. More specifically, the suction table 6 keeps sucking the printing tape A not only during stoppage of the printing tape A but also during feeding of the same, and hence the printing tape A is fed against the sucking force of the suction table 6 during a feeding operation. The width of an area in which a large number of suction holes 75 are arranged is set to the width (50 mm) of a printing tape A having the smallest width so as to prevent leakage of suction air. It should be noted that air discharged from the pair of suction fans 74, 74 may be guided to the tape feeding path 4 downstream of the suction table 6 to speed up drying of ink on the tape A.

As shown in FIGS. 1 to 3, the tape feeding mechanism 5 includes tape feed roller means 81 arranged at a location downstream of the suction table 6 in a feeding direction, a tape feed motor 82 for driving the tape feed roller means 81 for rotation, tension roller means 83 arranged at a location upstream of the suction table 6 in the feeding direction, and a pair of guide rollers 84, 84 (see FIG. 2) arranged at respective locations upstream and downstream of the suction table 6 and close to the same. The tape feed roller means 81 is comprised of a drive roller 81*a* and a free roller 81*b* opposed to each other via the printing tape A. The tape feed motor 82 is connected to the drive roller 81*a*.

Similarly, the tension roller means 83 is comprised of a brake roller 83*a* and a free roller 83*b* opposed to each other via the printing tape A. The brake roller 83*a* has a torque limiter fitted on a shaft thereof. Further, the pair of guide rollers 84, 84 position the printing tape A in the direction of width at the respective locations upstream and downstream of the suction table 6, and at the same time bring the same onto the suction table 6 in a horizontal position. In this construction, when the feed motor 82 is driven, the printing tape A is fed accurately while being stretched between the feed roller means 81 and the tension roller means 83. Accordingly, a portion of the printing tape A brought to the suction table 6 is sucked to the suction table 6 such that the portion is in the horizontal position in a stretched and positioned state.

At a location between the tape feed roller means 81 and the suction table 6, there is arranged a tape feed sensor 86 in a manner facing toward the tape feeding path 4. The tape feed sensor 86 and the tape feed motor 82 are connected to the controller 7. Marks C, referred to hereinafter, on the printing tape A are detected by the tape feed sensor 86, and feed operation (or pause operation) of the tape feed motor 82 is controlled based on the sensed marks C. As a result, feeding of the printing tape A, i.e. intermittent feed operation can always be performed accurately for each printable area Aa, described in detail hereinafter, of the printing tape A.

The tape supply device 8 and the tape take-up device 9 are arranged on respective opposite sides (upstream and downstream) of the base 2. The tape supply device 8 rolls out the printing tape A by free rotation, while the tape take-up device 9 takes up the same by forced rotation. The tape supply device 8 is comprised of a supply casing 91 and a reel 92 for rotatably supporting the printing tape (un-used tape) A wound into a roll around the reel 92. In this connection, it is preferred that the printing tape A is guided to the tape feeding mechanism 5 in a sagging state so as to eliminate influences (causing tension and oblique feeding) upon the tape feeding mechanism 5.

The tape take-up device 9 is comprised of a take-up casing 94, a take-up reel 95 arranged in the take-up casing 94, and a take-up motor 96 for driving the take-up reel 95 for rotation for taking up the printing tape (used tape) A. Also in the case of taking up the printing tape A, it is preferred that the printing tape A to be taken up is held in a sagging state so as to eliminate influences (causing tension and oblique feeding) upon the tape feeding mechanism 5.

Now, an image-printing method will be described with reference to FIGS. 1, 3 and 4A to 4D. In the printing apparatus 1, first, the tape feeding mechanism 5 is operated to feed a printing portion, i.e. a printable area Aa, of the printing tape A is fed onto the suction table 6. In this state, the suction table 6 is in operation, so that when feeding of the printing tape A is stopped, the printable area Aa of the printing tape A is sucked onto the suction table 6 and held in an immovable state. Then, the X-Y moving mechanism 23 is operated to move the head unit 21 in the main scanning and sub scanning directions (see FIG. 4A). During this motion of the head unit 21, inks are ejected from the respective ink jet heads 22, for image printing.

Figure 4A:
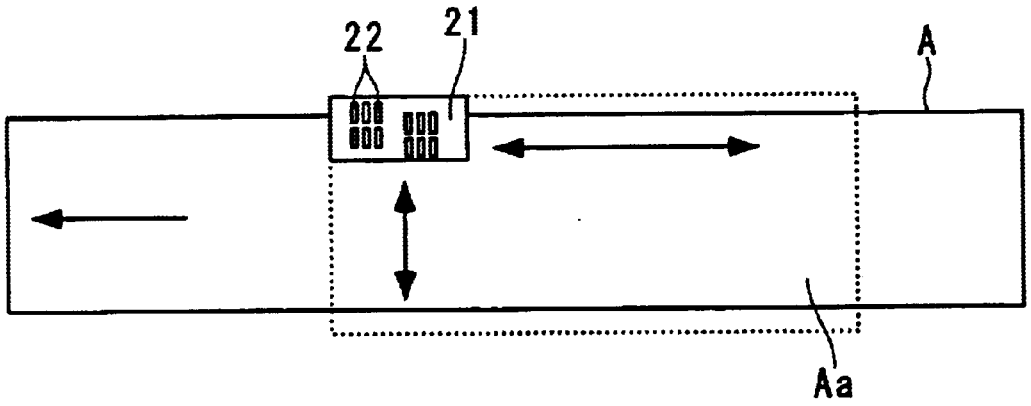
FIGS. 4A to 4D are views useful in explaining traveling operations of a head unit.
Figure 4B:
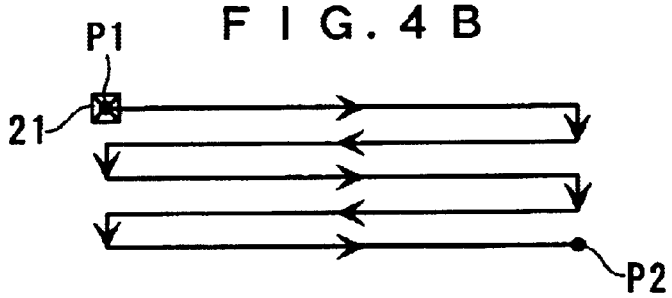
Figure 4C:
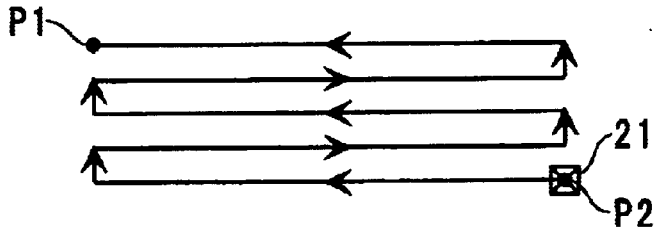
Figure 4D:
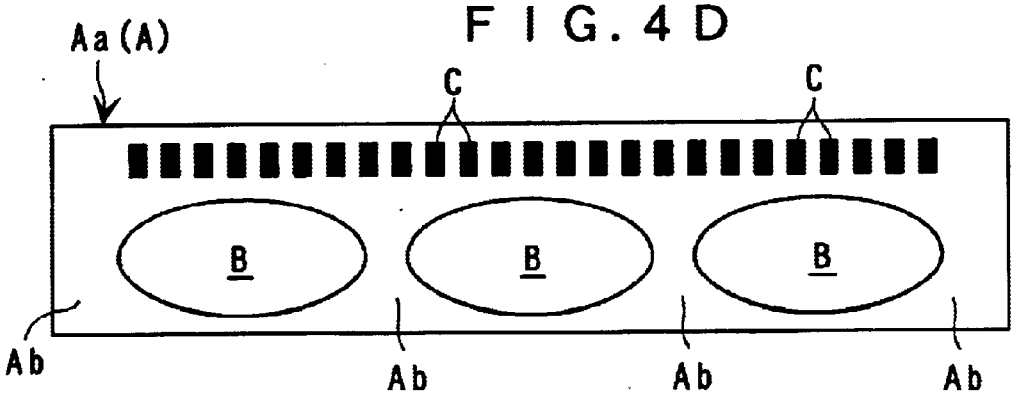

As shown in FIG. 4D, the image printing is performed for continuously printing a plurality of unit images B on respective label portions of the printing tape A at predetermined space intervals such that a space (non-printed portion Ab) is formed between each two of the label portions. In the printing, printing operation and tape feeding operation are repeatedly carried out, whereby a desired number of unit images B are printed on the printing tape A. At the same time, the marks C indicative of the position of each unit image B are also printed. More specifically, when the printing of the unit images B and the marks C on one printable area Aa is completed, the X-Y moving mechanism 23 stops. Then, the tape feeding mechanism 5 is operated to introduce another printable area Aa onto the suction table 6, whereupon the X-Y moving mechanism 23 is operated again to move the head unit 21 in the main scanning and sub scanning directions until the head unit 21 reaches the printing-start position P1. During this motion of the head unit 21, inks are ejected, whereby images (unit images B and marks C) are printed (see FIG. 4B).

FIG. 4D shows the result of the printing on a printable area Aa of the printing tape A. As shown in the figure, a plurality of unit images (label images) B are printed on the printing tape A at the predetermined space intervals in the direction in which the printing tape A extends, and a large number of marks C are also printed at predetermined intervals in parallel with the unit images B. The marks C are used for detection of the position of each unit image B when the printed portion of the printing tape A is subjected to half-cutting later as well as when the following printable area Aa is accurately fed onto the suction table 6, as described hereinabove. Needless to say, the printing tape A is required to be fed such that the above-mentioned space (non-printed portion Ab) between images can also be formed at a boundary between one printable area Aa and the following one.

Next, the head unit 21 will be described in more detail with reference to FIGS. 5, 11A, 11B, 12A, 12B and 13. As described above, three ink jet heads 22 forming one head group 48 are fixedly bonded to one sub-carriage 43, and the four sub-carriages 43 are removably mounted on the unitizing carriage 42 by the positioning pin group 44 of a plurality of pins. Each ink jet head 22 includes a vertically long rectangular head base plate 101. An ink supply block 102 of the ink jet head 22 is formed on the upper surface of one half portion of the head base plate 101 in a longitudinal direction, and the main body 22*a* of the ink jet head 22 projects downward from the lower surface of the same. Two ink jet heads 22, 22 belonging to respective different head groups 48 adjacent to each other in the sub scanning direction are arranged such that their main bodies 22*a* are opposed to each other in a back-to-back fashion.

Each sub-carriage 43 is formed e.g. of a stainless plate. The sub-carriage 43 has a generally square shape, and has one end portion thereof formed with a pair of lug portions 43*a*, 43*a* projecting laterally outward from respective opposite corners thereof. Further, in a lug portion-side half portion of the sub-carriage 43, there are formed three rectangular holes 104, 104, 104 in a manner aligned side by side, and in each of the three rectangular holes 104, 104, 104, the main body 22*a* of an ink jet head 22 is loosely fitted. Moreover, the sub-carriage 43 has a pair of positioning holes 105, 105 formed at respective opposite locations laterally outward of the row of the three rectangular holes 104, 104, 104, such that the positioning holes 105, 105 open in respective corresponding ones of the lug portions 43*a*. The pair of positioning holes 105, 105 are each formed to have a square shape and each engaged with a reference pin 111 or an angle-limiting pin 112, described in detail hereinafter, formed on the unitizing carriage 42.

Figure 11A:
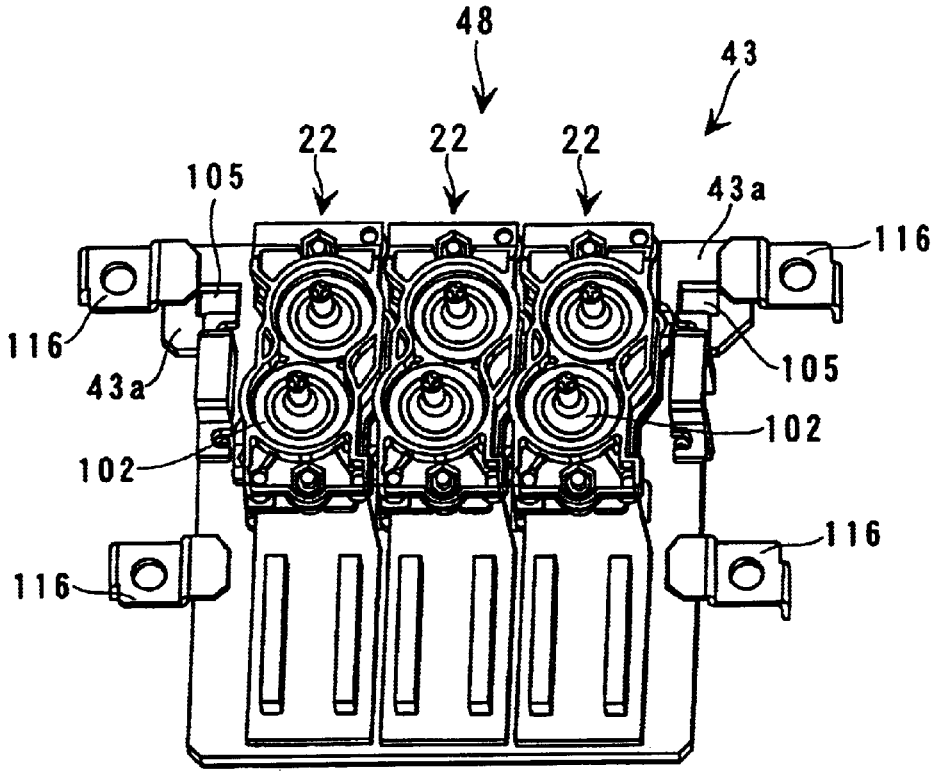
FIG. 11A is a perspective view of a sub-carriage as viewed from an top side.
Figure 11B:
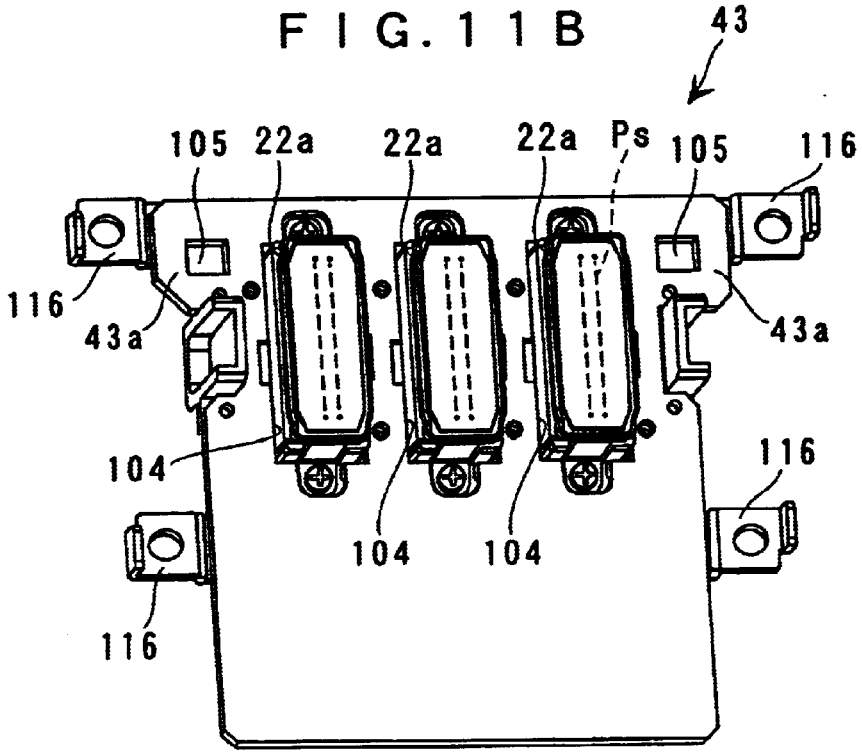
FIG. 11B is a perspective view of the sub-carriage as viewed from a bottom side.
Figure 12:
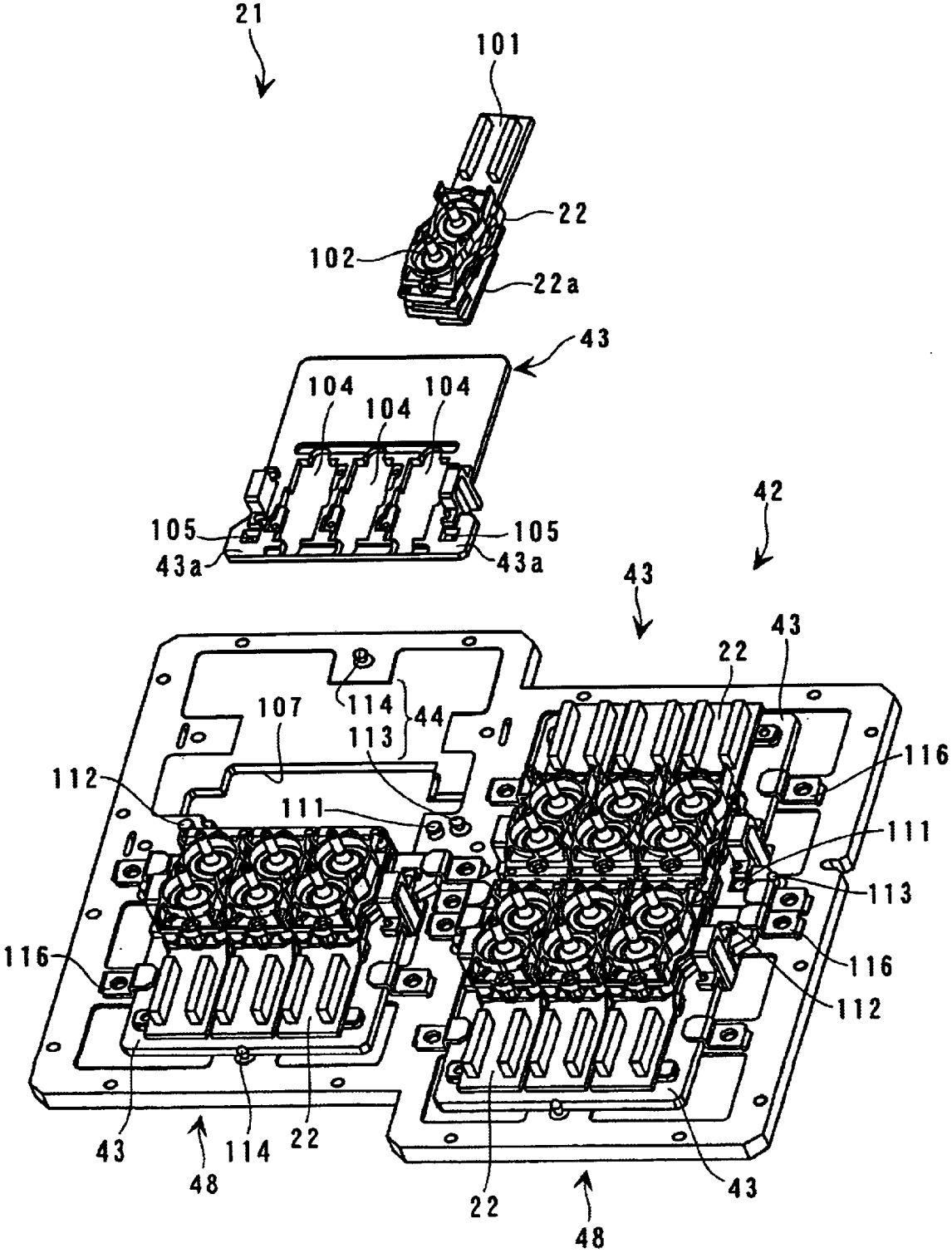
FIG. 12 is a partially exploded perspective view of the head unit as viewed from the top side.
Figure 13:
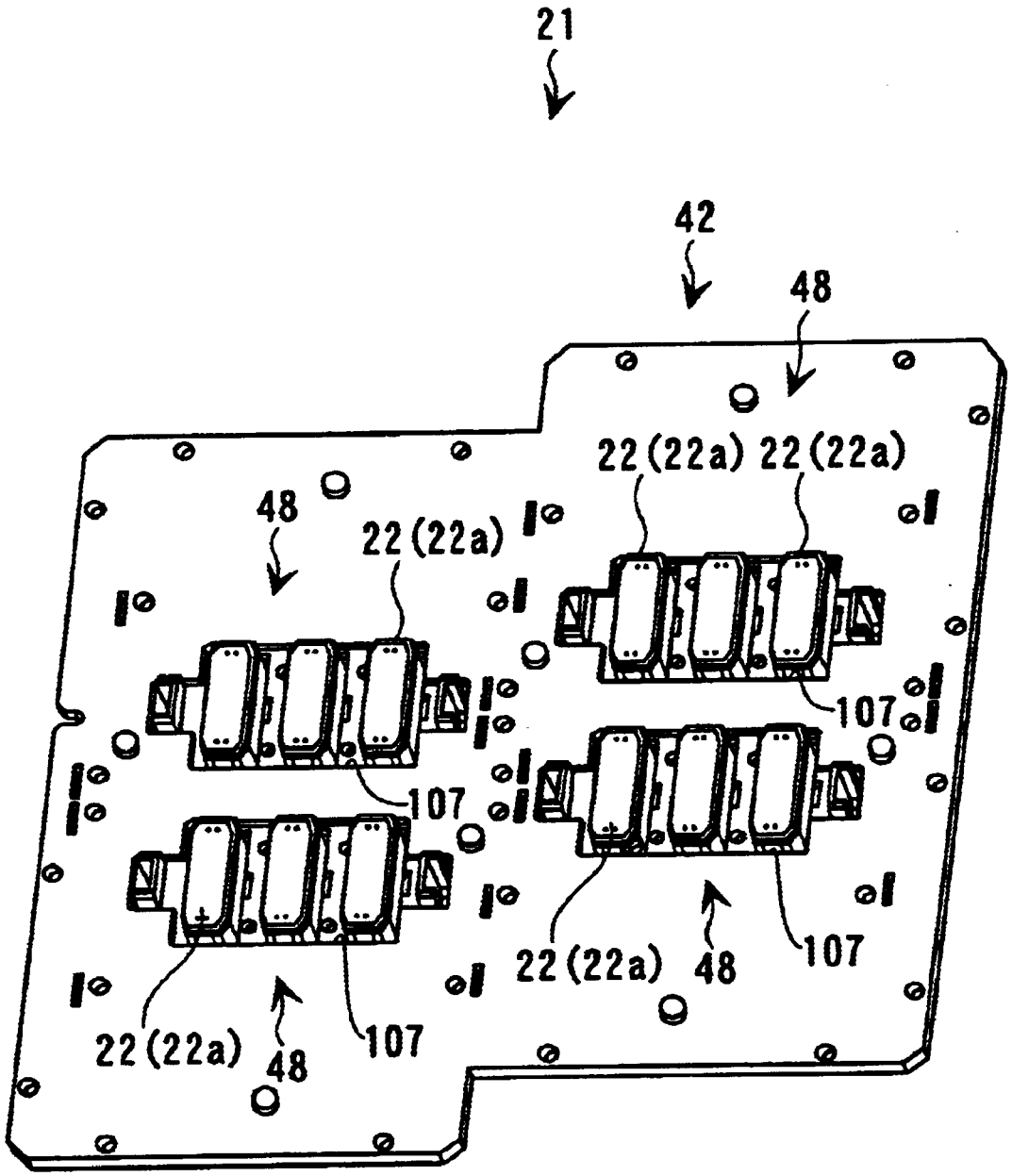
FIG. 13 is a perspective view of the head unit as viewed from the bottom side.

The ink jet heads 22 are each mounted onto the sub-carriages 43 by using a jig. More specifically, three ink jet heads 22 are disposed on a sub-carriage 43 set in a dedicated jig, and in this state each of the ink jet heads 22 is positioned accurately e.g. by using a microscope, followed by being fixedly bonded to the sub-carriage 43 by an adhesive poured between the ink jet head 22 and the square hole 104. Further, more preferably, the ink jet heads are screwed to the sub-carriage 43 after the bonding, as best shown in FIG. 11B.

The unitizing carriage 42 is formed e.g. of a thick stainless plate, and has a shape formed by joining two vertically long rectangles in a lateral direction in a state longitudinally displaced from each other. Further, the unitizing carriage 42 is formed with four groups of positioning pins 44 erected therefrom for disposing the four sub-carriages 43 in a staggered arrangement, and four head openings 107, 107, 107, 107 in which the four head groups 48 are fitted in. When the four sub-carriages 43 each having the ink jet heads 22 mounted thereon are mounted on the unitizing carriage 42, the main bodies 22*a* of the respective ink jet heads 22 project from the lower or underside surface of the unitizing carriage 42 via the respective head openings 107.

Each of the positioning pin groups 44 includes the reference pin 111 positioned on the unitizing carriage 42 at a location close to the center of the same, the angle-limiting pin 112 for positioning the rotational direction of the corresponding sub-carriage 43 on the unitizing carriage 42 with respect to the reference pin 111, an X-axis direction urging pin 113 for urging the sub-carriage 43 in the X-axis direction toward the reference pin 111 to thereby position the same in the Y-axis direction, and a Y-axis direction urging pin 114 for urging the sub-carriage 43 in the Y-axis direction toward the reference pin 111 to thereby position the same in the X-axis direction. The reference pin 111 and the angle-limiting pin 112 each having a cylindrical shape are fitted in a corresponding pair of positioning holes 105, 105 of the sub-carriage 43, respectively.

The reference pin 111 is accurately positioned by contact of the peripheral surface thereof with two adjacent sides of the corresponding positioning hole 105. The angle-limiting pin 112 is accurately positioned by contact of the peripheral surface thereof with one of the inner sides of the corresponding positioning hole 105, whereby the rotational direction of the sub-carriage 43 is positioned such that parallelism between the sub-carriage 43 and the unitizing carriage 42 can be maintained. When the sub-carriage 43 is accurately positioned with respect to the unitizing carriage 42 by the reference pin 111 and the angle-limiting pin 112, the position of the outermost ink nozzle of the divisional nozzle array 47*a*, which is closest to the reference pin 111, coincides with a designed reference position Ps.

The X-axis direction urging pin 113 is erected at a location close to the reference pin 111 and formed with an inverted droplet-shaped projection having resilient properties which allow the projection to swing. The X-axis direction urging pin 113 is in abutment with a side of the sub-carriage 43 to urge the same in the X-axis direction, whereby one side of the positioning hole 105 is pressed against the reference pin 111. Similarly, the Y-axis direction urging pin 114 is erected at a location forming a triangle together with the reference pin 111 and the angle-limiting pin 112 and formed with an inverted droplet-shaped projection having resilient properties which allow the projection to swing. The Y-axis direction urging pin 114 is in abutment with a rear side of the sub-carriage 43 to urge the same in the Y-axis direction, whereby the opposite positioning holes 105, 105 have respective one sides thereof pressed against the reference pin 111 and the angle-limiting pin 112.

In mounting of the sub-carriage 43 onto the unitizing carriage 42, the left and right positioning holes 105, 105 are aligned with the reference pin 111 and the angle-limiting pin 112, respectively, and then the sub-carriage 43 is pressed down onto the unitizing carriage 43. At this time, the X-axis direction urging pin 113 and the Y-axis direction urging pin 114 are each slightly tilted outwardly, and then presses the sub-carriage 43 toward the unitizing carriage 43 and at the same time urges the same in the respective X-axis and Y-axis directions by their resilient forces. The urging forces in the respective X-axis and Y-axis directions bring the left and right positioning holes 105, 105 into partial abutment with the reference pin 111 and the angle-limiting pin 112, whereby the sub-carriage 43 is accurately positioned with respect to the unitizing carriage 42. Preferably, the sub-carriage 43 accurately mounted on the unitizing carriage 42 is finally screwed to the unitizing carriage 42 at four sides thereof via respective retainers 116.

According to the above construction, the sub-carriage 43 and the head group 48 comprised of the three ink jet heads 22 are assembled with accuracy, and then the resulting sub-assembly is accurately mounted onto the unitizing carriage 42, so that accurate assembly of the ink jet heads 22 and the unitizing carriage 42 can be achieved after all. Further, even if one of the ink jet heads 22 becomes faulty, it is possible to demount only the sub-carriage 43 concerned from the unitizing carriage 42 and replace the faulty ink jet head 22 with a new one promptly without spoiling the mounting accuracy. Needless to say, the unitizing carriage is mounted to the support bracket 41 with accuracy.

Further, the sub-carriages 43 are arranged in a manner staggered from each other and with the respective longitudinally adjacent head groups 48, 48 disposed in a back-to-back fashion, whereby the four divisional ink nozzle array groups 47 are intensively arranged. This makes it possible to minimize positional displacement on a dot level measurement of location due to inaccuracy of moving position of the head unit 21 in the main scanning direction.

Figure 14A:
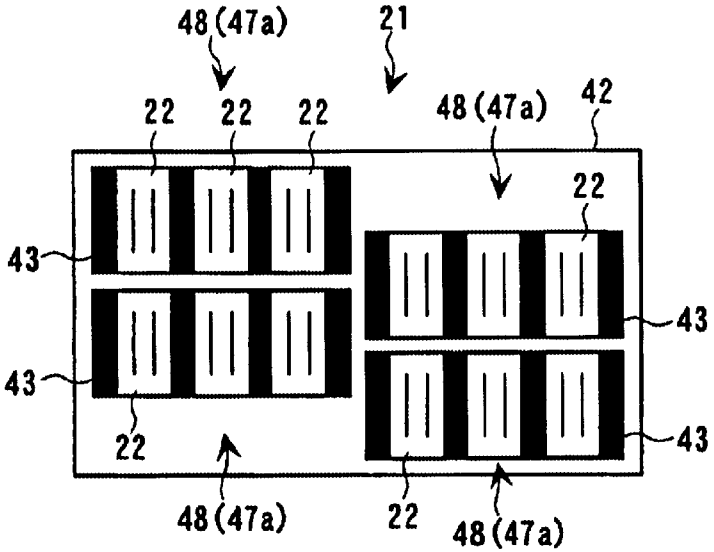
FIG. 14A is a view schematically showing the relationship between the head unit and ink nozzle arrays.
Figure 14B:
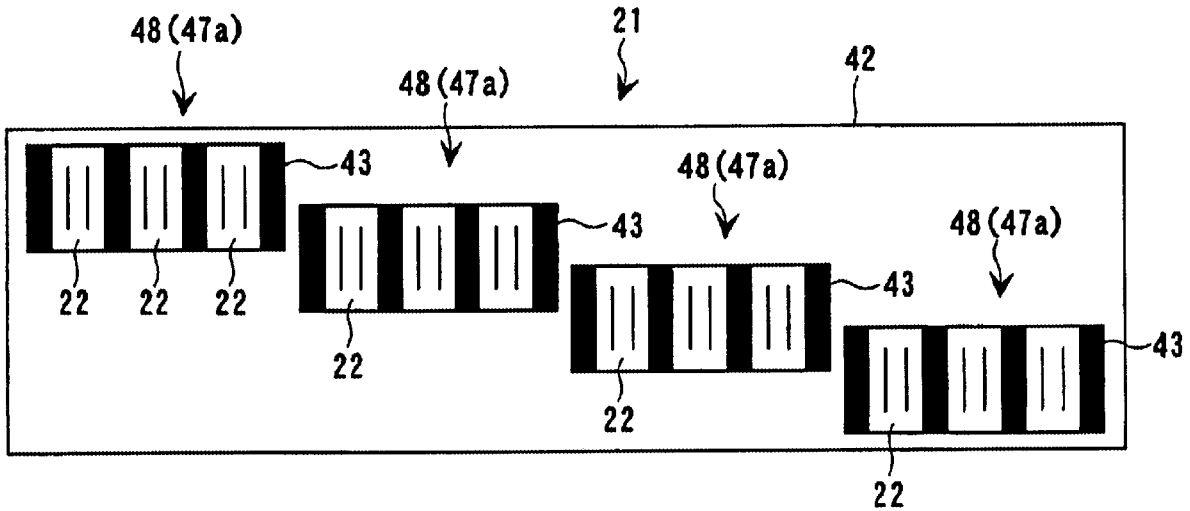
FIG. 14B is a view schematically showing the relationship between a variation of the head unit and ink nozzle arrays.

Although in the present embodiment, as shown in FIG. 14A, the four divisional ink nozzle array groups 47 are arranged in a manner staggered from each other to form the ink nozzle array group 46 for printing lines, the four divisional ink nozzle array groups 47 may be laterally arranged stepwise in the main scanning direction, as in the case of a variation of the head unit 21 shown in FIG. 14B, to form the ink nozzle array group 46 for one-line printing.

Figure 15A:
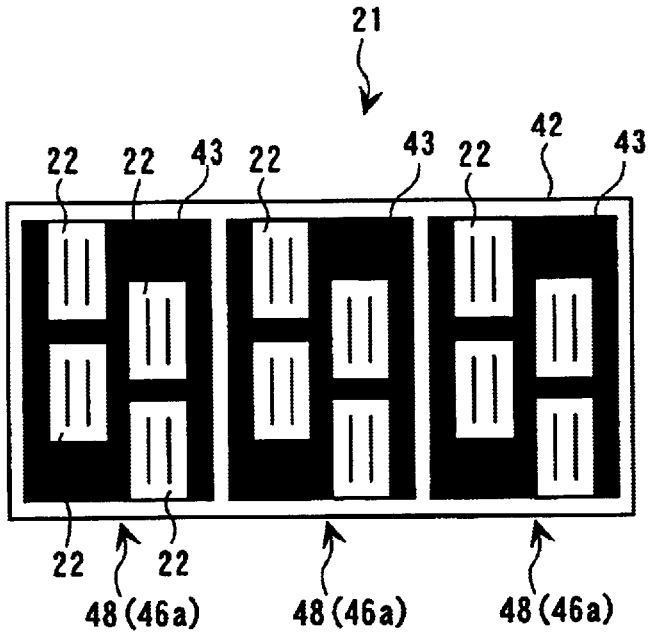
FIGS. 15A and 15B are views schematically showing the respective relationships between other variations of the head unit and ink nozzle arrays.
Figure 15B:
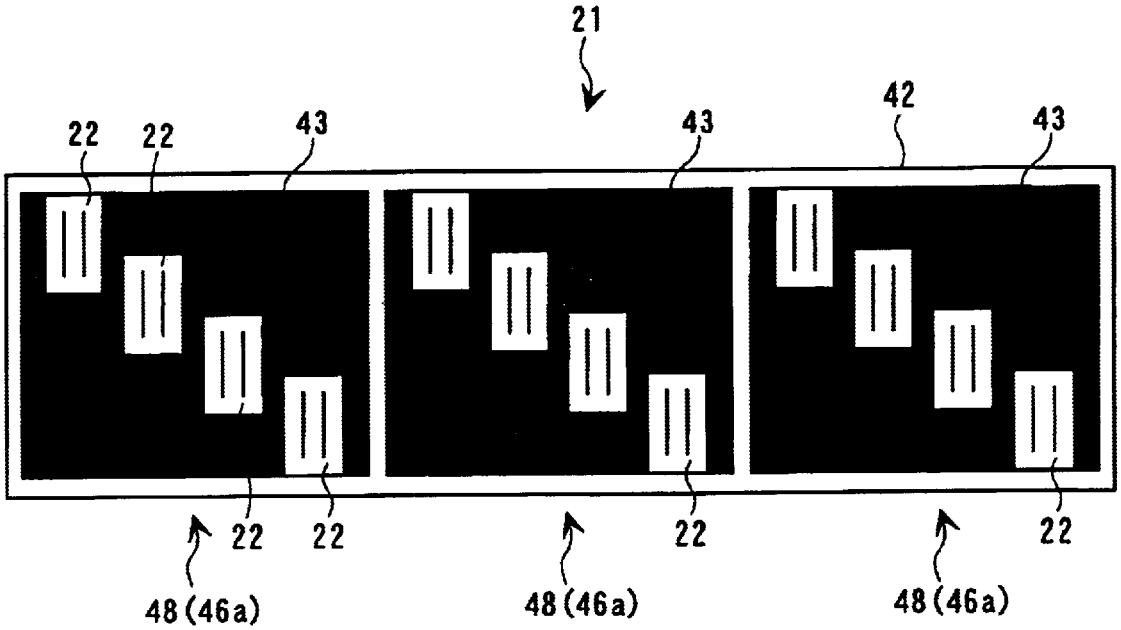

FIG. 15A shows another variation of the head unit 21, in which four ink jet heads forming an ink nozzle array group for printing lines are mounted on each sub-carriage 43 in a manner staggered from each other. In the case of the FIG. 15A head unit, for instance, on a left-hand sub-carriage 43 as viewed in the figure, two ink nozzle arrays 46*a* of black (K) and cyan (C) colors for one-line printing are each divided into four divisional ink nozzle arrays, and each of four ink jet heads 22 incorporates two of the divisional ink nozzle arrays of the respective black (K) and cyan (C) colors. Similarly, on an intermediate sub-carriage 43, two ink nozzle arrays 46*a* of magenta (M) and yellow (Y) colors are divided into four divisional ink nozzle arrays, and each of four ink jet heads 22 incorporates two of the divisional ink nozzle arrays of the respective magenta (M) and yellow (Y) colors, while on a right-hand one, two ink nozzle arrays 46*a* of light cyan (LC) and light magenta (LM) colors are divided into four divisional ink nozzle arrays, and each of four ink jet heads 22 incorporates two of the divisional ink nozzle arrays of the respective light cyan (LC) and light magenta (LM) colors. Further, FIG. 15B shows a still another variation of the head unit 21, in which four ink jet heads on each sub-carriage 43 are laterally arranged stepwise. The arrangements of the ink nozzle arrays 46*a* in FIGS. 14A, 14B make it possible to improve print quality of color printing by color matching, while the arrangements of the ink nozzle arrays 46*a* in FIGS. 15A, 15B make it possible to improve print quality of monochromatic color printing.

It should be noted that the number of sub-carriages and that of ink jet heads mounted on each sub-carriage are not limitative, but they can be changed as desired.

It is further understood by those skilled in the art that the foregoing is the preferred embodiment of the invention, and that various changes and modifications may be made without departing from the spirit and scope thereof.

What is claimed is:

1. An ink jet head unit for performing color printing by using a plurality of ink nozzle arrays each for use in printing one line, the plurality of ink nozzle arrays corresponding to a plurality of basic colors, the ink jet head unit comprising:

a plurality of head groups each formed by a plurality of ink jet heads, and having the plurality of ink nozzle arrays arranged therein such that the plurality of ink nozzle arrays are divided among the plurality of head groups;

a plurality of sub-carriages having respective ones of said plurality of head groups mounted thereon; and a unitizing carriage having said plurality of sub-carriages mounted thereon;

wherein the plurality of ink nozzle arrays are each divided into a plurality of divisional ink nozzle arrays with respect to a direction along the one line, and are grouped into a plurality of divisional ink nozzle array groups each formed of corresponding ones of said plurality of divisional ink nozzle arrays, and wherein the plurality of ink jet heads of each of said plurality of head groups have the plurality of divisional ink nozzle arrays of a corresponding one of the plurality of divisional ink nozzle array groups arranged therein such that the plurality of divisional ink nozzle arrays are divided among the plurality of ink jet heads.

2. An ink jet head unit according to claim 1, wherein the plurality of sub-carriages are arranged in a manner staggered from each other on said unitizing carriage.

3. An ink jet head unit according to claim 1, wherein the plurality of ink jet heads are bonded to a corresponding one of said plurality of sub-carriages in a positioned state.

4. An ink jet head unit for performing color printing by using a plurality of ink nozzle arrays each for use in printing one line, the plurality of ink nozzle arrays corresponding to a plurality of basic colors, the ink jet head unit comprising:

a plurality of head groups each formed by a plurality of ink jet heads, and having the plurality of ink nozzle arrays arranged therein such that the plurality of ink nozzle arrays are divided among the plurality of head groups;

a plurality of sub-carriages having respective ones of said plurality of head groups mounted thereon; and a unitizing carriage having said plurality of sub-carriages mounted thereon;

wherein the plurality of sub-carriages are arranged in a manner staggered from each other on said unitizing carriage;

wherein each of the ink jet heads comprises a head base plate, and a head body arranged in one substantial half of the head base plate toward one longitudinal side, the head body having a corresponding portion of the plurality of ink nozzle arrays arranged therein, and wherein in each two of the plurality of head groups, adjacent to each other with respect to a direction along the line, the head body of each of the plurality of ink jet heads of one of the two head groups and the head body of each of the plurality of ink jet heads of another of the two head groups are arranged opposed to each other in a back-to-back fashion.

5. An ink jet head unit for performing color printing by using a plurality of ink nozzle arrays each for use in printing one line, the plurality of ink nozzle arrays corresponding to a plurality of basic colors, the ink jet head unit comprising:

a plurality of head groups each formed by a plurality of ink jet heads, and having the plurality of ink nozzle arrays arranged therein such that the plurality of ink nozzle arrays are divided among the plurality of head groups;

a plurality of sub-carriages having respective ones of said plurality of head groups mounted thereon; and a unitizing carriage having said plurality of sub-carriages mounted thereon;

wherein said unitizing carriage has a plurality of positioning pin groups provided on a surface thereof, for enabling each of said plurality of sub-carriages to be mounted in a positioned state, and wherein each of said positioning pin groups positions a corresponding one of said plurality of sub-carriages on said unitizing carriage, with reference to a reference position set to a position of an outermost ink nozzle of an arbitrary one of the plurality of ink jet heads mounted on the corresponding one of said plurality of sub-carriages.

6. An ink jet head unit for performing color printing by using a plurality of ink nozzle arrays each for use in printing one line, the plurality of ink nozzle arrays corresponding to a plurality of basic colors, the ink jet head unit comprising:

a plurality of head groups each formed by a plurality of ink jet heads, and having the plurality of ink nozzle arrays arranged therein such that the plurality of ink nozzle arrays are divided among the plurality of head groups;

a plurality of sub-carriages having respective ones of said plurality of head groups mounted thereon; and a unitizing carriage having said plurality of sub-carriages mounted thereon;

wherein said unitizing carriage has a plurality of positioning pin groups provided on a surface thereof, for enabling each of said plurality of sub-carriages to be mounted in a positioned state;

wherein each of said positioning pin groups positions a corresponding one of said plurality of sub-carriages on said unitizing carriage, with reference to a reference position set to a position of an outermost ink nozzle of an arbitrary one of the plurality of ink jet heads mounted on the corresponding one of said plurality of sub-carriages; and wherein said each of said positioning pin groups comprises:

a reference pin arranged in a manner corresponding to the reference position;

an angle-limiting pin for positioning the corresponding one of said plurality of sub-carriages in a direction of rotation thereof about said reference pin on said unitizing carriage;

an X-axis direction urging pin for urging the corresponding one of said plurality of sub-carriages in an X-axis direction toward said reference pin to thereby position the corresponding one of said plurality of sub-carriages in a Y-axis direction perpendicular to the X-axis direction; and a Y-axis direction urging pin for urging the corresponding one of said plurality of sub-carriages in said Y-axis direction toward said reference pin to thereby position the corresponding one of said plurality of sub-carriages in said X-axis direction.

7. An ink jet printing apparatus including an ink jet head unit for performing color printing by using a plurality of ink nozzle arrays each for use in printing one line, the plurality of ink nozzle arrays corresponding to a plurality of basic colors, the ink jet head unit comprising:

a plurality of head groups each formed by a plurality of ink jet heads, and having the plurality of ink nozzle arrays arranged therein such that the plurality of ink nozzle arrays are divided among the plurality of head groups;

a plurality of sub-carriages having respective ones of said plurality of head groups mounted thereon; and a unitizing carriage having said plurality of sub-carriages mounted thereon;

wherein the plurality of ink nozzle arrays are each divided into a plurality of divisional ink nozzle arrays with respect to a direction along the one line, and are grouped into a plurality of divisional ink nozzle array groups each formed of corresponding ones of said plurality of divisional ink nozzle arrays, and wherein the plurality of ink jet heads of each of said plurality of head groups have the plurality of divisional ink nozzle arrays of a corresponding one of the plurality of divisional ink nozzle array groups arranged therein such that the plurality of divisional ink nozzle arrays are divided among the plurality of ink jet heads.

8. An ink jet printing apparatus according to claim 7, including an X-Y moving mechanism for moving said ink jet head unit in a main scanning direction and a sub scanning direction, and wherein the ink jet printing apparatus performs printing by causing said ink jet head unit to scan on a print medium in the main-scanning direction and the sub-scanning direction.

9. An ink jet printing apparatus according to claim 7, further including a cleaning cap unit for sucking ink from said ink jet head unit, in a state held in intimate contact with said ink jet head unit, and wherein said cleaning cap unit has a plurality of caps for intimate contact with said ink jet head unit, each of the plurality of caps having a size large enough to enclose at least one of the plurality of ink jet heads.

10. An ink jet printing apparatus according to claim 7, further including a storage cap unit for being brought into intimate contact with said ink jet head unit to thereby seal ink nozzles of the plurality of ink nozzle arrays, and wherein said storage cap unit is formed to have a size large enough to receive all of the ink jet heads of said ink jet head unit.

* * * * *